US008967901B1

(12) United States Patent
Holder

(10) Patent No.: US 8,967,901 B1
(45) Date of Patent: Mar. 3, 2015

(54) SAUCE BRUSH CAP FOR A SQUEEZE BOTTLE

(71) Applicant: Garry Holder, Nunnelly, TN (US)

(72) Inventor: Garry Holder, Nunnelly, TN (US)

( * ) Notice: Subject to any disclaimer, the term of this patent is extended or adjusted under 35 U.S.C. 154(b) by 0 days.

(21) Appl. No.: 14/490,329

(22) Filed: Sep. 18, 2014

(51) Int. Cl.
*A47L 13/22* (2006.01)
*A46B 11/00* (2006.01)

(52) U.S. Cl.
CPC ..... *A46B 11/0041* (2013.01)
USPC ..... 401/282; 401/207; 401/183

(58) Field of Classification Search
USPC ..... 401/268, 282, 290, 183, 184, 185, 186, 401/207, 203, 289
See application file for complete search history.

(56) References Cited

U.S. PATENT DOCUMENTS 8,262,307 B1 9/2012 Cross

*Primary Examiner* — David Walczak
(74) *Attorney, Agent, or Firm* — Crossley Patent Law

(57) ABSTRACT

A sauce brush cap for a squeeze bottle including a housing for an applicator devised to engage a threaded upper end of a squeeze bottle and having a brush with inflammable bristles to dispense sauce from the squeeze bottle onto a food item being grilled without igniting the bristles. The housing and the applicator are hollow to permit the dispensing of the sauce as well as to permit an unused portion of the sauce to return into the squeeze bottle.

6 Claims, 3 Drawing Sheets

SAUCE BRUSH CAP FOR A SQUEEZE BOTTLE

BACKGROUND OF THE INVENTION

Various types of sauce dispensing caps are known in the prior art. However, what is needed is a sauce brush cap for a squeeze bottle including a housing for an applicator devised to engage a threaded upper end of a squeeze bottle and having a brush with inflammable bristles to dispense sauce from the squeeze bottle onto a food item being grilled without igniting the bristles. The housing and the applicator are hollow to permit the dispensing of the sauce as well as to permit an unused portion of the sauce to return into the squeeze bottle.

FIELD OF THE INVENTION

The present invention relates to sauce applicators, and more particularly, to a sauce brush cap for a squeeze bottle.

SUMMARY OF THE INVENTION

The general purpose of the present sauce brush cap for a squeeze bottle, described subsequently in greater detail, is to provide a sauce brush cap for a squeeze bottle which has many novel features that result in a sauce brush cap for a squeeze bottle which is not anticipated, rendered obvious, suggested, or even implied by prior art, either alone or in combination thereof.

To accomplish this, the present sauce brush cap for a squeeze bottle includes a housing for an applicator devised to engage a threaded upper end of a squeeze bottle and having a brush with inflammable bristles to dispense sauce onto a food item being grilled. The housing includes an annular collar disposed on the bottom end thereof, an annular first connector disposed on a top surface of the collar top surface, an annular second connector disposed on a top side of the first connector, a housing member disposed on the upper side of the second connector; and a central compartment continuously longitudinally disposed therethrough. A threaded exterior surface is disposed within the central compartment of the collar. The first connector has a diameter smaller than a diameter of the collar. The second connector has a diameter larger than the diameter of the first connector and smaller than the diameter of the collar.

The applicator includes an annular threaded lower end with an external side that removably engages the threaded exterior surface. The lower end has a height equal to a height of the threaded exterior surface to prevent leakage. The applicator also includes a hollow frustoconical base disposed atop a top edge of the lower end as well as a brush. The base has a maximum width smaller than a maximum width of the lower end. The brush has a hollow neck portion attached to a topmost end of the base and includes a plurality of inflammable bristles extending from the neck portion outwardly from the housing member.

The housing and the applicator are hollow to permit the passage of a sauce contained within the squeeze bottle from the lower end of the applicator, through the base, and outwardly from the brush for application of the sauce with the bristles and to return a unused portion of the sauce to the squeeze bottle. The housing and the applicator are dishwasher safe. In addition, the housing and the applicator lower end and base are preferably plastic, although other materials that promote the functionality of the present device can be used.

Thus has been broadly outlined the more important features of the present sauce brush cap for a squeeze bottle so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
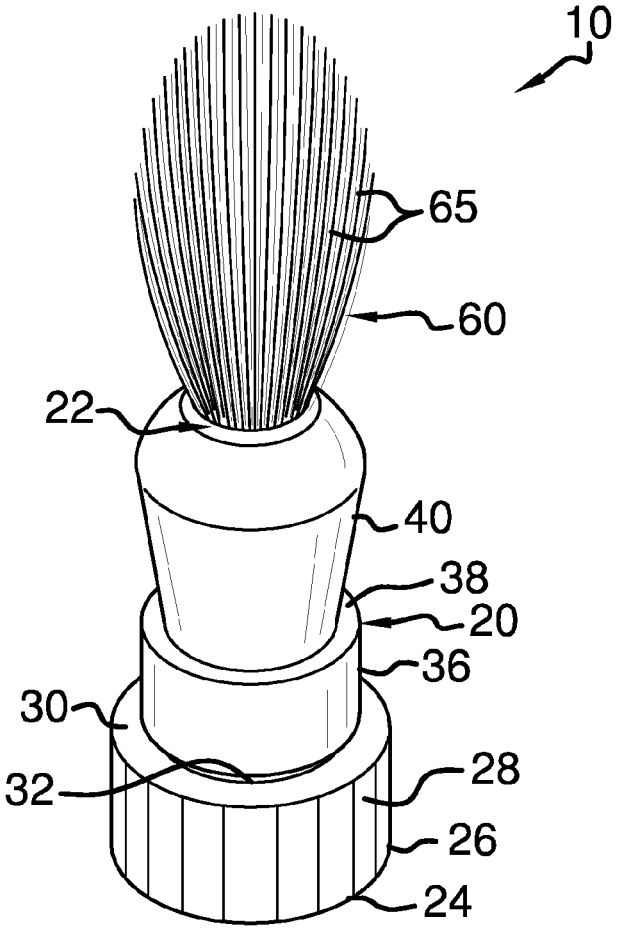
FIG. 1 is an isometric view.
Figure 2:
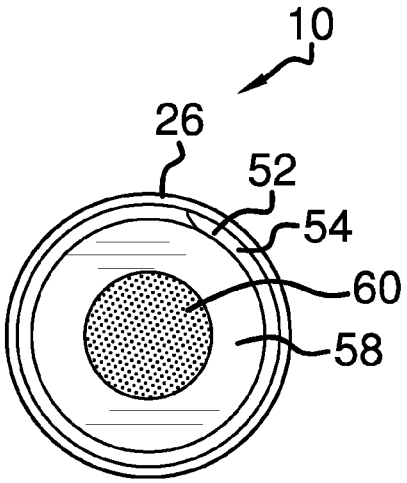
FIG. 2 is a bottom plan view.
Figure 3:
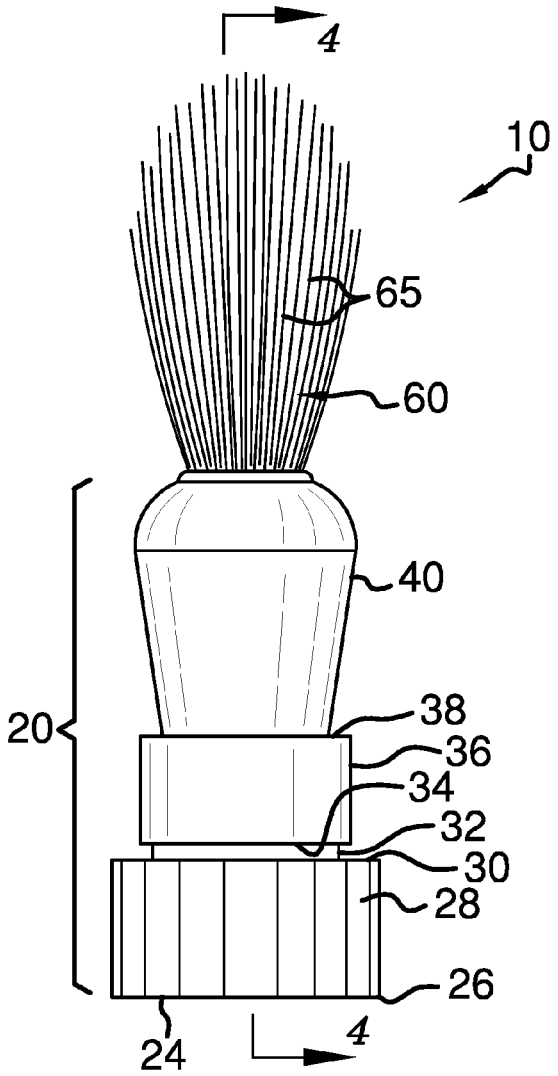
FIG. 3 is a side elevation view.
Figure 4:
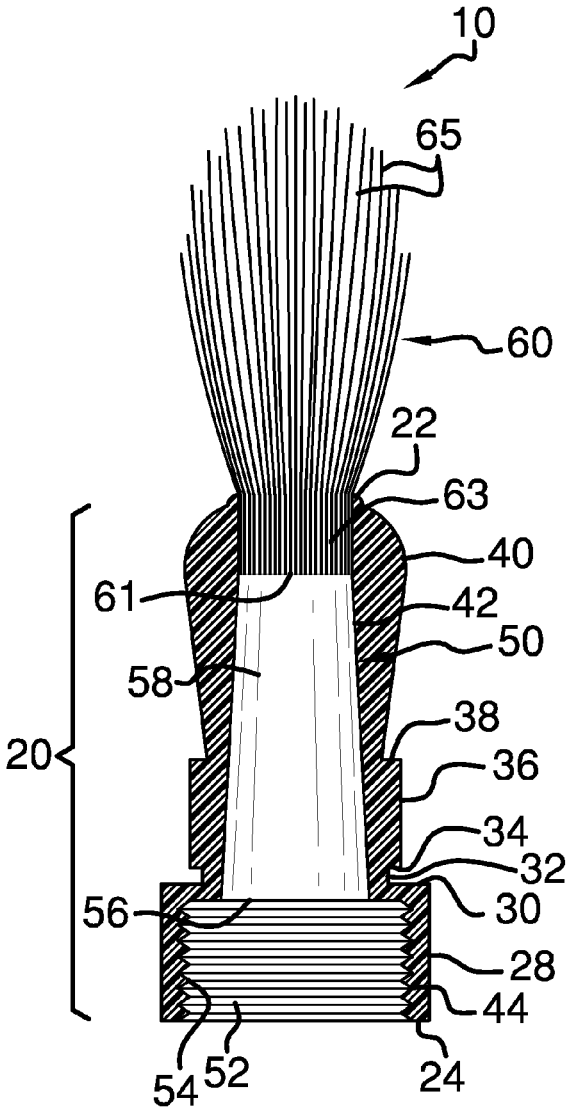
FIG. 4 is a cross-sectional view taken along line 4-4 of FIG. 3.
Figure 5:
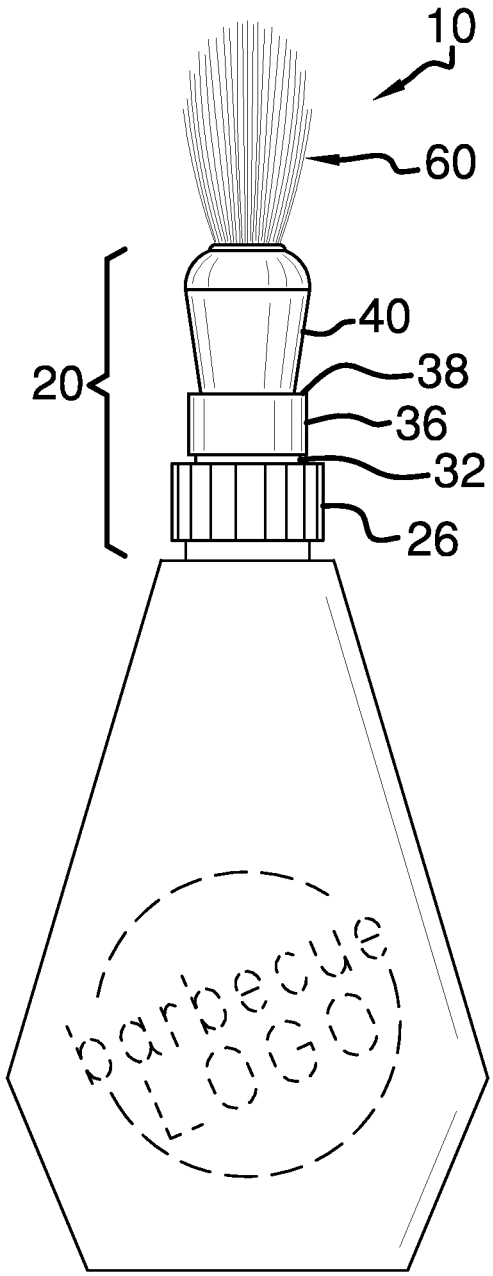
FIG. 5 is an in-use front elevation view attached to a squeeze bottle.

With reference now to the drawings, and in particular FIGS. 1 through 5 thereof, an example of the instant sauce brush cap for a squeeze bottle employing the principles and concepts of the present sauce brush cap for a squeeze bottle and generally designated by the reference number 10 will be described.

Referring to FIGS. 1 through 5, the present sauce brush cap for a squeeze bottle 10 is illustrated. The sauce brush cap for a squeeze bottle 10 includes a housing 20 having a top end 22 and a bottom end 24. The housing 20 includes an annular collar 26 disposed on the bottom end 24. The collar 26 has an exterior surface 28 and a top surface 30. The housing 20 also includes an annular first connector 32 disposed on the collar 26 top surface 30. The first connector 32 has a top side 34 and further has a diameter smaller than a diameter of the collar 26. An annular second connector 36 of the housing 20 is disposed on the top side 34 of the first connector 32. The second connector 36 has an upper side 38. The second connector 36 has a diameter larger than the diameter of the first connector 32 and smaller than the diameter of the collar 26. The housing 20 further includes a housing member 40 disposed on the upper side 38 of the second connector 36. In addition, the housing 20 includes a central compartment 42 continuously disposed through the housing member 40, the second connector 36, the first connector 32, and the collar 26. A threaded exterior surface 44 is disposed within the central compartment 42 of the collar 26. An applicator 50 is disposed within the central compartment 42 of the housing 20 and extends outwardly from the housing member 40.

The applicator 50 includes an annular threaded lower end 52. The lower end 52 has an external side 54 that removably engages the threaded exterior surface 44 and is configured to engage a threaded upper end of a squeeze bottle. The lower end 52 has a top edge 56. The lower end 52 has a height equal to a height of the threaded exterior surface 44 to prevent leakage. The applicator 50 also includes a hollow frustoconical base 58 disposed atop the top edge 56 of the lower end 52 as well as a brush 60. The base 58 has a topmost end 61. The base 58 has a maximum width smaller than a maximum width of the lower end 52. The brush 60 has a hollow neck portion 63 attached to the base 58 topmost end 61 and includes a plurality of bristles 65 extending from the neck portion 63 outwardly from the housing member 40. The bristles 65 allow a use to dispense sauce onto a food item while being grilled and are inflammable to prevent the bristles from being ignited during use.

The housing 20 and the applicator 50 are hollow to permit the passage of a sauce contained within the squeeze bottle from the lower end 52 of the applicator 50, through the base 58, and outwardly from the brush 60 for application of the sauce with the bristles 65 and to return an unused portion of the sauce into the squeeze bottle. The housing 20 and the applicator 50 are dishwasher safe. In addition, the housing 20 and the applicator 50 lower end 52 and base 58 are preferably plastic, although other materials that promote the functionality of the present device 10 can be used.

What is claimed is:

1. A sauce brush cap for a squeeze bottle comprising:

a housing having a top end and a bottom end, the housing comprising:

an annular collar disposed on the bottom end, the collar having an exterior surface and a top surface;

an annular first connector disposed on the collar top surface, the first connector having a top side, the first connector further having a diameter smaller than a diameter of the collar;

an annular second connector disposed on the top side of the first connector, the second connector having an upper side, the second connector having a diameter larger than the diameter of the first connector and smaller than the diameter of the collar;

a housing member disposed on the upper side of the second connector;

a central compartment continuously disposed through the housing member, the second connector, the first connector, and the collar;

a threaded exterior surface disposed within the central compartment of the collar;

an applicator disposed within the central compartment of the housing and extending outwardly from the housing member, the applicator comprising:

an annular threaded lower end, the lower end having a top edge, an external side, the external side removably engaging the threaded exterior surface of the collar;

a hollow frustoconical base disposed atop the top edge of the lower end, wherein the base has a maximum width smaller than a maximum width of the lower end, the base having a topmost end disposed within the housing member; and a brush having a hollow neck portion attached to the base topmost end, the brush comprising a plurality of bristles extending from the neck portion outwardly from the housing member;

wherein the applicator lower end is configured to engage a threaded upper end of a squeeze bottle.

2. The sauce brush cap for a squeeze bottle of claim 1 wherein the lower end has a height equal to a height of the threaded exterior surface.

3. The sauce brush cap for a squeeze bottle of claim 2 wherein the bristles are inflammable.

4. The sauce brush cap for a squeeze bottle of claim 3 wherein the housing and the applicator are configured to permit the passage of a sauce contained within the squeeze bottle from the lower end of the applicator, through the base, and outwardly from the brush for application of the sauce and to return an unused portion of the sauce to the squeeze bottle.

5. The sauce brush cap for a squeeze bottle of claim 4 wherein the housing and the applicator are dishwasher safe.

6. The sauce brush cap for a squeeze bottle of claim 5 wherein the housing and the applicator lower end and base are plastic.

* * * * *